US009006987B2

(12) United States Patent
Maxik et al.

(10) Patent No.: US 9,006,987 B2
(45) Date of Patent: Apr. 14, 2015

(54) WALL-MOUNTABLE LUMINAIRE AND ASSOCIATED SYSTEMS AND METHODS

(71) Applicant: Lighting Science Group Corporation, Satellite Beach, FL (US)

(72) Inventors: Fredric S. Maxik, Indialantic, FL (US); David E. Bartine, Cocoa, FL (US); Mark Andrew Oostdyk, Cape Canaveral, FL (US); Matthew Regan, Melbourne, FL (US); Addy S. Widjaja, Palm Bay, FL (US)

(73) Assignee: Lighting Science Group, Inc., Melbourne, FL (US)

( * ) Notice: Subject to any disclaimer, the term of this patent is extended or adjusted under 35 U.S.C. 154(b) by 156 days.

(21) Appl. No.: 13/888,564

(22) Filed: May 7, 2013

(65) Prior Publication Data

US 2014/0028210 A1 Jan. 30, 2014

Related U.S. Application Data

(60) Provisional application No. 61/643,687, filed on May 7, 2012.

(51) Int. Cl.
*F21V 23/06* (2006.01)
*H05B 37/02* (2006.01)

(Continued)

(52) U.S. Cl.
CPC ..... *F21V 23/06* (2013.01); *H05B 37/0272* (2013.01); *F21S 8/035* (2013.01); *F21S 9/024* (2013.01)

(58) Field of Classification Search
CPC ..... F21V 23/06; H05B 37/02; H01R 27/00
USPC ..... 315/200 R, 291; 362/640, 641–659; 439/217, 218
See application file for complete search history.

(56) References Cited

U.S. PATENT DOCUMENTS 1,703,524 A 2/1929 Grandjean
3,706,882 A 12/1972 Eby (Continued)

FOREIGN PATENT DOCUMENTS

CN 101 702 421 A 5/2010
EP 0851260 7/1998

(Continued)

OTHER PUBLICATIONS

U.S. Appl. No. 13/709,942, filed Dec. 2012, Fredric S. Maxik et al.

(Continued)

*Primary Examiner* — Douglas W Owens
*Assistant Examiner* — Wei Chan
(74) *Attorney, Agent, or Firm* — Mark R. Malek; William A. Harding; Widerman Malek, PL

(57) ABSTRACT

A wall-mountable luminaire may include interchangeable adapter plugs having first and second male connectors, the first of which connects electrically and mechanically to an external electrical socket, and the second of which connects electrically and mechanically to an on-board multi-standard socket. A power supply may detect a plurality of electrical power types received from the multi-standard socket, and may condition that input power to drive LEDs. Remote computing devices may transmit control data wirelessly to direct a controller to selectively operate the LEDs to form a modified distribution pattern. A housing assembly may support wall mounting of the luminaire, and trim assembly may define a cavity that provides aesthetic and protective cover for the components carried by the housing assembly. A method aspect of the invention details steps for operating the luminaire.

20 Claims, 12 Drawing Sheets

(51) Int. Cl.

| | |
|---|---|
| ***H01R 27/00*** | (2006.01) |
| ***F21S 8/00*** | (2006.01) |
| ***F21S 9/02*** | (2006.01) |

(56) References Cited

U.S. PATENT DOCUMENTS

| | | | | |
|---|---|---|---|---|
| 4,551,654 | A | 11/1985 | Barnum et al. | |
| 4,942,384 | A | 7/1990 | Yamauchi et al. | |
| 5,319,301 | A | 6/1994 | Callahan et al. | |
| 5,523,878 | A | 6/1996 | Wallace et al. | |
| 5,563,422 | A | 10/1996 | Nakamura et al. | |
| 5,680,230 | A | 10/1997 | Kaburagi et al. | |
| 5,704,701 | A | 1/1998 | Kavanagh et al. | |
| 5,747,976 | A | 5/1998 | Wong et al. | |
| 5,813,753 | A | 9/1998 | Vriens et al. | |
| 5,936,599 | A | 8/1999 | Reymond et al. | |
| 5,997,150 | A | 12/1999 | Anderson | |
| 6,016,038 | A * | 1/2000 | Mueller et al. | 315/291 |
| 6,140,646 | A | 10/2000 | Busta et al. | |
| 6,259,572 | B1 | 7/2001 | Meyer, Jr. | |
| 6,272,154 | B1 | 8/2001 | Bala et al. | |
| 6,341,876 | B1 | 1/2002 | Moss et al. | |
| 6,356,700 | B1 | 3/2002 | Strobl | |
| 6,478,440 | B1 * | 11/2002 | Jaworski et al. | 362/96 |
| 6,561,656 | B1 | 5/2003 | Kojima et al. | |
| 6,586,882 | B1 | 7/2003 | Harbers | |
| 6,594,090 | B2 | 7/2003 | Kruschwitz et al. | |
| 6,733,135 | B2 | 5/2004 | Dho | |
| 6,734,639 | B2 | 5/2004 | Chang et al. | |
| 6,762,562 | B2 | 7/2004 | Leong | |
| 6,767,111 | B1 | 7/2004 | Lai | |
| 6,787,999 | B2 | 9/2004 | Stimac et al. | |
| 6,817,735 | B2 | 11/2004 | Shimizu et al. | |
| 6,853,150 | B2 | 2/2005 | Clauberg et al. | |
| 6,870,523 | B1 | 3/2005 | Ben-David et al. | |
| 6,871,982 | B2 | 3/2005 | Holman et al. | |
| 6,876,007 | B2 | 4/2005 | Yamazaki et al. | |
| 6,917,754 | B2 * | 7/2005 | Pedrotti et al. | 392/395 |
| 6,940,101 | B2 | 9/2005 | Yano et al. | |
| 6,967,761 | B2 | 11/2005 | Starkweather et al. | |
| 6,974,713 | B2 | 12/2005 | Patel et al. | |
| 7,015,636 | B2 | 3/2006 | Bolta | |
| 7,042,623 | B1 | 5/2006 | Huibers et al. | |
| 7,058,197 | B1 | 6/2006 | McGuire et al. | |
| 7,066,628 | B2 | 6/2006 | Allen | |
| 7,070,281 | B2 | 7/2006 | Kato | |
| 7,072,096 | B2 | 7/2006 | Holman et al. | |
| 7,075,707 | B1 | 7/2006 | Rapaport et al. | |
| 7,083,304 | B2 | 8/2006 | Rhoads | |
| 7,095,053 | B2 | 8/2006 | Mazzochette et al. | |
| 7,138,770 | B2 | 11/2006 | Uang et al. | |
| 7,144,131 | B2 | 12/2006 | Rains | |
| 7,157,745 | B2 | 1/2007 | Blonder et al. | |
| 7,178,941 | B2 | 2/2007 | Roberge et al. | |
| 7,184,201 | B2 | 2/2007 | Duncan | |
| 7,186,016 | B2 * | 3/2007 | Jao | 362/644 |
| 7,187,484 | B2 | 3/2007 | Mehrl | |
| 7,213,926 | B2 | 5/2007 | May et al. | |
| 7,234,844 | B2 | 6/2007 | Bolta et al. | |
| 7,246,923 | B2 | 7/2007 | Conner | |
| 7,247,874 | B2 | 7/2007 | Bode et al. | |
| 7,252,408 | B2 | 8/2007 | Mazzochete et al. | |
| 7,255,469 | B2 | 8/2007 | Wheatley et al. | |
| 7,261,453 | B2 | 8/2007 | Morejon et al. | |
| 7,277,626 | B2 * | 10/2007 | Pesu et al. | 392/390 |
| 7,289,090 | B2 | 10/2007 | Morgan | |
| 7,300,177 | B2 | 11/2007 | Conner | |
| 7,303,291 | B2 | 12/2007 | Ikeda et al. | |
| 7,318,659 | B2 * | 1/2008 | Demarest et al. | 362/253 |
| 7,319,293 | B2 | 1/2008 | Maxik | |
| 7,325,956 | B2 | 2/2008 | Morejon et al. | |
| 7,342,658 | B2 | 3/2008 | Kowarz et al. | |
| 7,344,279 | B2 | 3/2008 | Mueller et al. | |
| 7,349,095 | B2 | 3/2008 | Kurosaki | |
| 7,353,859 | B2 | 4/2008 | Stevanovic et al. | |
| 7,369,056 | B2 | 5/2008 | McCollough et al. | |
| 7,382,091 | B2 | 6/2008 | Chen | |
| 7,382,632 | B2 | 6/2008 | Alo et al. | |
| 7,400,439 | B2 | 7/2008 | Holman | |
| 7,427,146 | B2 | 9/2008 | Conner | |
| 7,429,983 | B2 | 9/2008 | Islam | |
| 7,434,946 | B2 | 10/2008 | Huibers | |
| 7,436,996 | B2 | 10/2008 | Ben-Chorin | |
| 7,438,443 | B2 | 10/2008 | Tatsuno et al. | |
| 7,476,016 | B2 | 1/2009 | Kurihara | |
| 7,484,860 | B2 * | 2/2009 | Demarest et al. | 362/253 |
| 7,489,086 | B2 | 2/2009 | Miskin et al. | |
| 7,497,596 | B2 | 3/2009 | Ge | |
| 7,520,607 | B2 | 4/2009 | Casper et al. | |
| 7,520,642 | B2 | 4/2009 | Holman et al. | |
| 7,521,875 | B2 | 4/2009 | Maxik | |
| 7,528,421 | B2 | 5/2009 | Mazzochete | |
| 7,530,708 | B2 | 5/2009 | Park | |
| 7,537,347 | B2 | 5/2009 | Dewald | |
| 7,540,616 | B2 | 6/2009 | Conner | |
| 7,556,376 | B2 | 7/2009 | Ishak et al. | |
| 7,556,406 | B2 | 7/2009 | Petroski et al. | |
| 7,567,040 | B2 | 7/2009 | Pong et al. | |
| 7,598,682 | B2 | 10/2009 | Grajcar | |
| 7,598,686 | B2 | 10/2009 | Lys et al. | |
| 7,598,961 | B2 | 10/2009 | Higgins | |
| 7,605,971 | B2 | 10/2009 | Ishii et al. | |
| 7,611,253 | B2 * | 11/2009 | Chien | 362/84 |
| 7,619,372 | B2 | 11/2009 | Garrity | |
| 7,626,755 | B2 | 12/2009 | Furuya et al. | |
| 7,633,093 | B2 | 12/2009 | Blonder et al. | |
| 7,633,779 | B2 | 12/2009 | Garrity et al. | |
| 7,637,643 | B2 | 12/2009 | Maxik | |
| 7,677,736 | B2 | 3/2010 | Kasazumi et al. | |
| 7,679,281 | B2 | 3/2010 | Kim et al. | |
| 7,684,007 | B2 | 3/2010 | Hull et al. | |
| 7,703,943 | B2 | 4/2010 | Li et al. | |
| 7,705,810 | B2 | 4/2010 | Choi et al. | |
| 7,708,452 | B2 | 5/2010 | Maxik et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,732,825 | B2 | 6/2010 | Kim et al. | |
| 7,766,490 | B2 | 8/2010 | Harbers et al. | |
| 7,767,900 | B2 * | 8/2010 | Abe et al. | 84/645 |
| 7,819,556 | B2 | 10/2010 | Heffington et al. | |
| 7,828,453 | B2 | 11/2010 | Tran et al. | |
| 7,828,465 | B2 | 11/2010 | Roberge et al. | |
| 7,832,878 | B2 | 11/2010 | Brukilacchio et al. | |
| 7,834,867 | B2 | 11/2010 | Sprague et al. | |
| 7,835,056 | B2 | 11/2010 | Doucet et al. | |
| 7,840,123 | B2 * | 11/2010 | Belongia et al. | 392/392 |
| 7,841,714 | B2 | 11/2010 | Gruber | |
| 7,845,823 | B2 | 12/2010 | Mueller et al. | |
| 7,852,017 | B1 | 12/2010 | Melanson | |
| 7,855,376 | B2 | 12/2010 | Cantin et al. | |
| 7,871,839 | B2 | 1/2011 | Lee | |
| 7,880,400 | B2 | 2/2011 | Zhou et al. | |
| 7,889,430 | B2 | 2/2011 | El-Ghoroury et al. | |
| 7,902,769 | B2 | 3/2011 | Shteynberg et al. | |
| 7,906,789 | B2 | 3/2011 | Jung et al. | |
| 7,928,565 | B2 | 4/2011 | Brunschwiler et al. | |
| 7,932,482 | B2 * | 4/2011 | Norwood et al. | 219/506 |
| 7,964,883 | B2 | 6/2011 | Mazzochete et al. | |
| 7,972,030 | B2 | 7/2011 | Li | |
| 7,976,182 | B2 | 7/2011 | Ribarich | |
| 7,976,205 | B2 | 7/2011 | Grotsch et al. | |
| 8,016,443 | B2 | 9/2011 | Falicoff et al. | |
| 8,022,634 | B2 | 9/2011 | Greenfeld et al. | |
| 8,040,070 | B2 | 10/2011 | Myers et al. | |
| 8,047,660 | B2 | 11/2011 | Penn et al. | |
| 8,049,763 | B2 | 11/2011 | Kwak et al. | |
| 8,061,857 | B2 | 11/2011 | Liu et al. | |
| 8,070,302 | B2 | 12/2011 | Hatanaka et al. | |
| 8,076,680 | B2 | 12/2011 | Lee et al. | |
| 8,083,364 | B2 | 12/2011 | Allen | |
| 8,083,376 | B2 * | 12/2011 | Chien | 362/276 |
| 8,096,668 | B2 | 1/2012 | Abu-Ageel | |
| 8,115,419 | B2 | 2/2012 | Given et al. | |

(56) References Cited

U.S. PATENT DOCUMENTS

| | | | | |
|---|---|---|---|---|
| 8,157,422 | B2 * | 4/2012 | Paik et al. | 362/294 |
| 8,164,844 | B2 | 4/2012 | Toda et al. | |
| 8,182,115 | B2 | 5/2012 | Takahashi et al. | |
| 8,188,687 | B2 | 5/2012 | Lee et al. | |
| 8,192,047 | B2 | 6/2012 | Bailey et al. | |
| 8,212,494 | B2 | 7/2012 | Veltman et al. | |
| 8,212,836 | B2 | 7/2012 | Matsumoto et al. | |
| 8,253,336 | B2 | 8/2012 | Maxik et al. | |
| 8,256,921 | B2 | 9/2012 | Crookham et al. | |
| 8,274,089 | B2 | 9/2012 | Lee | |
| 8,297,783 | B2 | 10/2012 | Kim | |
| 8,303,158 | B2 * | 11/2012 | Chien | 362/646 |
| 8,304,978 | B2 | 11/2012 | Kim et al. | |
| 8,310,171 | B2 | 11/2012 | Reisenauer et al. | |
| 8,319,445 | B2 | 11/2012 | McKinney et al. | |
| 8,324,823 | B2 | 12/2012 | Choi et al. | |
| 8,324,840 | B2 | 12/2012 | Shteynberg et al. | |
| 8,331,099 | B2 | 12/2012 | Geissler et al. | |
| 8,337,029 | B2 | 12/2012 | Li | |
| 8,378,574 | B2 | 2/2013 | Schlangen et al. | |
| 8,384,984 | B2 | 2/2013 | Maxik et al. | |
| 8,401,231 | B2 | 3/2013 | Maxik et al. | |
| 8,410,717 | B2 | 4/2013 | Shteynberg et al. | |
| 8,410,725 | B2 | 4/2013 | Jacobs et al. | |
| 8,427,590 | B2 | 4/2013 | Raring et al. | |
| 8,441,210 | B2 | 5/2013 | Shteynberg et al. | |
| 8,465,167 | B2 | 6/2013 | Maxik et al. | |
| 8,772,675 | B2 * | 7/2014 | Juarez | 219/209 |
| 2003/0194355 | A1 * | 10/2003 | Pedrotti et al. | 422/124 |
| 2004/0033171 | A1 * | 2/2004 | Kvietok et al. | 422/123 |
| 2004/0052076 | A1 | 3/2004 | Mueller et al. | |
| 2004/0105261 | A1 * | 6/2004 | Ducharme et al. | 362/231 |
| 2005/0195600 | A1 * | 9/2005 | Porchia et al. | 362/240 |
| 2005/0218780 | A1 | 10/2005 | Chen | |
| 2005/0253533 | A1 * | 11/2005 | Lys et al. | 315/224 |
| 2005/0267213 | A1 | 12/2005 | Gold et al. | |
| 2005/0275626 | A1 * | 12/2005 | Mueller et al. | 345/156 |
| 2006/0002108 | A1 | 1/2006 | Ouderkirk et al. | |
| 2006/0002110 | A1 * | 1/2006 | Dowling et al. | 362/252 |
| 2006/0002153 | A1 * | 1/2006 | Currie et al. | 362/641 |
| 2006/0007709 | A1 * | 1/2006 | Yuen | 362/641 |
| 2006/0012987 | A9 * | 1/2006 | Ducharme et al. | 362/231 |
| 2006/0164005 | A1 | 7/2006 | Sun | |
| 2006/0209569 | A1 * | 9/2006 | Yuen | 362/641 |
| 2006/0232992 | A1 | 10/2006 | Bertram et al. | |
| 2006/0285193 | A1 | 12/2006 | Kimura et al. | |
| 2007/0013871 | A1 | 1/2007 | Marshall et al. | |
| 2007/0159492 | A1 | 7/2007 | Lo et al. | |
| 2007/0188847 | A1 | 8/2007 | McDonald et al. | |
| 2007/0241340 | A1 | 10/2007 | Pan | |
| 2007/0253222 | A1 * | 11/2007 | Driska et al. | 362/641 |
| 2007/0262714 | A1 | 11/2007 | Bylsma | |
| 2008/0119912 | A1 | 5/2008 | Hayes | |
| 2008/0143973 | A1 | 6/2008 | Wu | |
| 2008/0198572 | A1 | 8/2008 | Medendorp | |
| 2008/0232084 | A1 | 9/2008 | Kon | |
| 2008/0258643 | A1 | 10/2008 | Cheng et al. | |
| 2009/0009102 | A1 | 1/2009 | Kahlman et al. | |
| 2009/0059099 | A1 | 3/2009 | Linkov et al. | |
| 2009/0059585 | A1 | 3/2009 | Chen et al. | |
| 2009/0128781 | A1 | 5/2009 | Li | |
| 2009/0160370 | A1 | 6/2009 | Tai et al. | |
| 2009/0175041 | A1 | 7/2009 | Yuen et al. | |
| 2009/0200952 | A1 | 8/2009 | King et al. | |
| 2009/0225568 | A1 * | 9/2009 | Spartano et al. | 362/641 |
| 2009/0232683 | A1 | 9/2009 | Hirata et al. | |
| 2009/0273931 | A1 | 11/2009 | Ito et al. | |
| 2009/0284960 | A1 * | 11/2009 | Chien | 362/157 |
| 2010/0001652 | A1 | 1/2010 | Damsleth | |
| 2010/0006762 | A1 | 1/2010 | Yoshida et al. | |
| 2010/0051976 | A1 | 3/2010 | Rooymans | |
| 2010/0053959 | A1 | 3/2010 | Ijzerman et al. | |
| 2010/0096376 | A1 * | 4/2010 | Hsiao | 219/201 |
| 2010/0103389 | A1 | 4/2010 | McVea et al. | |
| 2010/0202129 | A1 | 8/2010 | Abu-Ageel | |
| 2010/0231863 | A1 | 9/2010 | Hikmet et al. | |
| 2010/0244700 | A1 | 9/2010 | Chong et al. | |
| 2010/0244740 | A1 | 9/2010 | Alpert et al. | |
| 2010/0270942 | A1 | 10/2010 | Hui et al. | |
| 2010/0277067 | A1 | 11/2010 | Maxik et al. | |
| 2010/0277084 | A1 | 11/2010 | Lee et al. | |
| 2010/0277952 | A1 * | 11/2010 | Chien | 362/641 |
| 2010/0290254 | A1 * | 11/2010 | Howard et al. | 362/641 |
| 2010/0315320 | A1 | 12/2010 | Yoshida | |
| 2010/0320927 | A1 | 12/2010 | Gray et al. | |
| 2010/0320928 | A1 | 12/2010 | Kaihotsu et al. | |
| 2010/0321641 | A1 | 12/2010 | Van Der Lubbe | |
| 2011/0012137 | A1 | 1/2011 | Lin et al. | |
| 2011/0080635 | A1 | 4/2011 | Takeuchi | |
| 2011/0110118 | A1 * | 5/2011 | Hsiao | 362/643 |
| 2011/0248640 | A1 | 10/2011 | Welten | |
| 2011/0309759 | A1 | 12/2011 | Shteynberg et al. | |
| 2011/0310446 | A1 | 12/2011 | Komatsu | |
| 2012/0024837 | A1 * | 2/2012 | Thompson | 219/433 |
| 2012/0082461 | A1 * | 4/2012 | Meyer et al. | 398/106 |
| 2012/0127759 | A1 * | 5/2012 | Chien | 362/641 |
| 2012/0286672 | A1 | 11/2012 | Holland et al. | |
| 2012/0286700 | A1 | 11/2012 | Maxik et al. | |
| 2012/0287245 | A1 | 11/2012 | Holland et al. | |
| 2012/0287271 | A1 | 11/2012 | Holland et al. | |
| 2012/0320572 | A1 * | 12/2012 | Fischer et al. | 362/183 |
| 2012/0326623 | A1 | 12/2012 | Fatt et al. | |
| 2013/0140988 | A1 | 6/2013 | Maxik et al. | |
| 2013/0188350 | A1 * | 7/2013 | Sheek | 362/235 |
| 2013/0265743 | A1 * | 10/2013 | Lee | 362/96 |
| 2014/0139120 | A1 * | 5/2014 | Chien | 315/155 |
| 2014/0185325 | A1 * | 7/2014 | Howard et al. | 362/641 |
| 2014/0320663 | A1 * | 10/2014 | Chien | 348/159 |

FOREIGN PATENT DOCUMENTS

| | | |
|---|---|---|
| JP | 2005534155 | 11/2005 |
| JP | 2008226567 | 9/2008 |
| WO | WO03098977 | 11/2003 |
| WO | WO2009121539 A1 | 10/2009 |
| WO | WO2010027459 | 3/2010 |
| WO | WO2010098811 | 9/2010 |
| WO | WO2011008251 | 1/2011 |
| WO | WO2011016860 | 2/2011 |
| WO | WO2012064470 | 5/2012 |
| WO | WO2012135173 | 10/2012 |
| WO | WO2012158665 | 11/2012 |

OTHER PUBLICATIONS

U.S. Appl. No. 13/715,085, filed Dec. 2012, Fredric S. Maxik et al.
U.S. Appl. No. 13/737,606, filed Jan. 2013, Fredric S. Maxik et al.
U.S. Appl. No. 13/739,665, filed Jan. 2013, Fredric S. Maxik et al.
Tannith Cattermole, "Smart Energy Glass controls light on demand", Gizmag.com, Apr. 18, 2010 accessed Nov. 1, 2011.
US 4,970,436, 11/1990, Sacchetti (withdrawn)
US 4,992,701, 02/1991, Sacchetti (withdrawn)

* cited by examiner

WALL-MOUNTABLE LUMINAIRE AND ASSOCIATED SYSTEMS AND METHODS

RELATED APPLICATIONS

This application claims the benefit under 35 U.S.C. §119 (e) of U.S. Provisional Patent Application Ser. No. 61/643,687 filed on May 7, 2012 and titled Wall Mountable Light and Associated Methods, the entire contents of which are incorporated herein by reference.

FIELD OF THE INVENTION

The present invention relates to the field of lighting and, more specifically, to low-profile wall-wash luminaires, and associated systems and methods.

BACKGROUND OF THE INVENTION

Lighting designed to illuminate vertical surfaces such as walls typically is called wall-wash lighting. Wall-wash lighting devices commonly include a light source, a power supply, and a mounting mechanism. A wall-wash lighting device mounted above a substantially vertical surface to be illuminated is classified as a down light. A wall-wash lighting device positioned below a substantially vertical surface to be illuminated is called an up light. While presently available ceiling-, floor-, or wall-mounted wall-wash lighting devices are capable of illuminating wall surfaces, problems in design still remain.

Most of the existing wall-wash lighting devices provide an illumination pattern of non-uniform light intensities when projected upon vertical wall surfaces. Specifically, existing wall-wash lighting devices suffer from strong illumination near the light source and a weakening, parabolic-shaped lighting pattern as the projection distance from the light source increases. Use of light emitting diodes (LEDs) in the light source of a wall-wash lighting device may compound the problem of non-uniform illumination. By the nature of their design and operation, LEDs tend to emit light in a more directional manner than a conventional light source. For example, incandescent light bulbs typically emit light at a uniform luminous intensity level in all directions (360 degree spherical arc about the filament). By contrast, an LED module in a luminaire typically emits light over a cone of 120 to 150 degrees. As a result, even use of a globe-shaped optic to shape the emissions of an LED may not produce an equal distribution of light.

Nonetheless, digital lighting technologies such as LEDs offer significant advantages over legacy lamps (including better lighting quality, longer operating life, and lower energy consumption). Therefore, equipping wall-wash lighting devices with LEDs remains a design goal in the lighting industry. To achieve broader and more uniform illumination patterns using LEDs, most of the commonly available wall-wash lighting devices employ physically larger components involved in light emission or projection. However, this design trade-off often results in a wall-wash lighting device that may deliver acceptable illumination, but that also presents an obtrusive and aesthetically unappealing appearance as installed. This is especially true where a large wall-wash lighting device is deployed in a surface-mount configuration.

Powering wall-mount lighting devices also may pose challenges for both the designer and manufacturer. Because lighting devices must connect to a power supply to operate, the designer faces the choice of either extending electrical wire behind a wall to a point where a wall-mount lighting device is to be mounted, or covering or otherwise minimizing the exposure of unsightly power cables extending from the wall-mount lighting device to the nearest standard double-plug wall outlet. Even if a power outlet is available on a wall surface at the position desired for mounting of a wall-wash light lighting device, space behind the device often is reserved to stow excess electrical wiring without preventing flush mounting of the lighting device upon the plane defined by the wall surface.

Because lighting devices may be purchased for use with differing power supply systems (e.g., 120V 15 amp in North America, 240V 15 amp in Europe), the manufacturer faces the challenge of designing an affordable wall-wash lighting device that may be used effectively and safely across a broad landscape of potentially profitable markets. Additionally, a manufacturer's choice of light sources also places limits on power circuitry present in a lamp design. For example, conventional light sources typically require AC power. LEDs, however, are low-voltage light sources that require constant DC voltage to operate optimally and, therefore, must be carefully regulated. Too little current and voltage may result in little or no light. Too much current and voltage can damage the light-emitting junction of the LED. Consequently, LEDs are commonly supplemented with individual power adapters to convert AC voltage to the proper DC voltage, and to regulate the current flowing through during operation to protect the LEDs from line-voltage fluctuations.

Controlling the operation of lighting devices typically is accomplished by a user manually manipulating a switch, thereby engaging or disengaging an electrical current flowing to the lighting device. Attempts to remotely control operation of lighting devices typically involve inclusion of a radio receiver which may receive light source manipulation commands (including "on" and "off"). However, such radio receivers typically require an antenna located within the lighting device. Due to the nature of light-generating and heat-generating elements (particularly in an LED-based lighting device), as well as components included to dissipate the generated heat, the radio signal that may be received by the radio receiver may be attenuated. The attenuation of the signal may result in a substantially decreased range in which the LED-based lighting device may communicate with the remote control, thereby decreasing the practicality and deployment flexibility of the lighting device.

The lighting industry is experiencing advancements in LED applications, some of which may be pertinent to certain aspects of wall-wash lighting devices.

U.S. Pat. No. 7,659,674 to Blackwell et al. is directed to an LED-based night light device that supports a wall-mount configuration, and that delivers increased illumination beam width through employment of one or more of reflectors, optics, and multiple LEDs. The disclosure includes an associated method for wirelessly controlling the lighting module using a network. However, the disclosure presumes the availability of power delivery components (e.g., power plug, AC-DC converter) that are suitable for a specific external power source.

U.S. Patent Publication No. 2012/0320572 to Fisher et al. discloses a power source for an LED bulb that receives line current as its input, and supplies low voltage DC as its output. The power source is arranged to reduce the input voltage from 120 vAC to a low DC voltage (e.g., 12 vDC). However, the disclosed power source presumes conductors (e.g., wiring) extending from the wall receptacle to the LED-based lamp. Such visible conductors are not aesthetically pleasing for wall-mount applications.

U.S. Patent Publication No. 2012/0326623 to Fatt et al. discloses a socket adapter for an LED lamp that includes an adaptor body and an AC-DC converter disposed in the adapter body. The socket adapter supports various base configurations for attaching the socket adapter to an AC power source. However, the disclosed socket adapter only supports a single input power type, as defined by the pairing of the base configuration and the matching on-board converter.

A need exists for an LED-based wall-wash lighting device that may provide a large and substantially uniform wall-wash illumination pattern, while at the same time presenting an unobtrusive and clean appearance when installed. Additional improvements may be made to support diverse power supplies and connection means prevalent in major target markets, and to facilitate remote control of the operation of the wall-wash lighting device.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a luminaire that may be used to produce remotely-configurable wall-wash illumination. The wall-mountable luminaire of an embodiment of the present invention may advantageously emit a large, uniform wall illumination pattern from a structure that is less obtrusive when installed and, therefore, more aesthetically desirable than traditional lighting devices. The wall-mountable luminaire of an embodiment of the present invention may advantageously support diverse types of input power, thereby making the present invention easier and safer to install than traditional lighting devices. The wall-mountable luminaire according to an embodiment of the present invention may advantageously support remote operation, thereby promoting both ease of use and flexibility of installation compared to traditional lighting devices. The wall-mountable luminaire may include power delivery components, lighting generation components, and mechanical support components.

The power delivery components may include one or more removable adapter plugs, a multi-standard socket, and a power supply. Each adapter plug may have male connectors configured to removably couple (both mechanically and electrically) to an electrical outlet, and also male connectors configured to removably couple (both mechanically and electrically) to the multi-standard socket. Each adapter plug may receive electricity of at least one power type from an electrical outlet, and all adapter plugs may connect interchangeably to the multi-standard socket. The power supply may receive any one of a plurality of types of electrical power from the multi-standard socket, and may tailor that input power to deliver a type of electrical power required by those lighting generation components that need electricity to operate. The plurality of input power types supported by the power supply may include 120V AC, 240V AC, 12V DC, and 24V DC. The power supply may detect an input AC voltage and to convert the input AC voltage to an output DC voltage.

The light generating components of the luminaire according to an embodiment of the present invention may include a light source, a heat sink, a controller, and an optic. The light source may include a plurality of light-emitting elements, at least one of which may comprise a light-emitting diode (LED). The heat sink may be in thermal communication with the light-emitting elements. The controller may generate control signals to selectively operate the light-emitting elements to emit a combined light. The optic may be disposed adjacent to the light source to define an optical chamber. The combined light from the light source may enter the optical chamber and pass through the optic to form a modified distribution pattern. The optic may have a substantially linear collimator, a curved emission surface, and/or a plurality of pillows configured to spread the combined light.

Additionally, the lighting system components may include a communication network, as well as a local wireless receiver and a remote computerized device both in data communication with the communication network. The controller may receive control data from the wireless receiver defining desired light characteristics, and may generate the control signals such that the combined light exhibits the light characteristics. The control data may includes a light generation command such as a dimmer command, an on/off command, a color change command, and a wash pattern redirect command. The control data may be transmitted by the remote computerized device through the communication network to the wireless receiver. The wireless receiver may receive data encoded to a standard network protocol such as 802.3 Ethernet, 802.11 Wi-Fi, 802.15.1 Bluetooth, 802.15.4 low rate personal area network (PAN), packet switching wide area networks (WAN), and cellular relay WAN. The remote computerized device may be a personal computer (PC), a tablet, a smartphone, a personal data assistant, or a wireless remote control.

The mechanical support components may include a housing assembly and a trim assembly. The housing assembly may have a substantially planar mounting, and also a recessed portion configured to individually receive each of the plurality of adapter plugs. When connected mechanically to the multi-standard socket, an engaged adapter plug may be disposed adjacent to the recessed portion. In this manner, each of the adapter plugs may be interchangeably connectable mechanically to the housing assembly. The housing assembly also may carry the multi-standard socket, the power supply, the light source, the controller, and the trim assembly.

Additionally, the housing assembly may carry the wireless receiver and heat sink. The housing assembly also may have an electromagnetic interference shield that shields the wireless receiver from electromagnetic emissions from the heat sink. The trim assembly may include a base, sidewalls extending upwardly from the base, and a top carried by the sidewalls that may combine to define a cavity. The trim assembly may advantageously provide aesthetic and protective cover within the cavity for the components assembled to be carried by the housing assembly. The top of the trim may include the optic. The trim assembly also may be in thermal communication with the heat sink, the light source, and/or the power source.

A method aspect of the present invention is for producing wall-wash illumination using the wall-mountable luminaire. The method may include the steps of coupling the multi-standard socket to one of the adapter plugs, fitting the adapter plug into the recessed portion of the housing assembly, coupling the adapter plug to a standard electrical outlet with the mounting of the housing assembly positioned flush to an electrical outlet, receiving a first type of input power at the power supply, and operating the light source. The method may further include receiving AC voltage at the power supply, converting the AC voltage to DC voltage, and regulating the DC voltage to drive LEDs. The method may still further include the steps of positioning the controller in wireless data communication with the remote computerized device through the communication network, receiving control data defining light characteristics, and programming the controller to generate control signals to selectively operate the light source to exhibit the light characteristics. The method may also include the steps of using the trim assembly to cover the housing assembly, the engaged adapter plug, the multi-standard socket, the power supply, the light source, and the controller, directing the combined light into the optical chamber, and passing the combined light through the optic to form a modified distribution pattern.

DETAILED DESCRIPTION OF THE INVENTION

Figure 1:
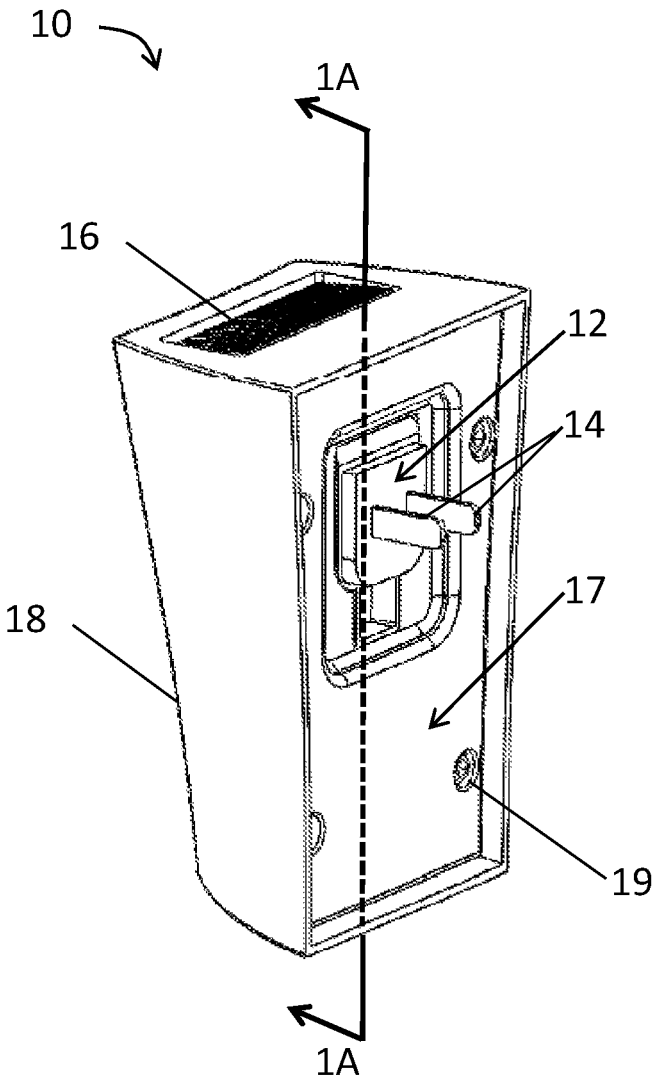
FIG. 1 is a top rear perspective view of a wall-mountable luminaire according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention. Like numbers refer to like elements throughout.

Referring now to FIGS. 1-13, a wall-mountable luminaire 10 according to an embodiment of the present invention is now described in detail. Throughout this disclosure, the present invention may be referred to as a luminaire 10, a lighting system, an LED lighting system, a lamp system, a lamp, a device, a system, a product, and a method. Those skilled in the art will appreciate that this terminology is only illustrative and does not affect the scope of the invention. For instance, the present invention may just as easily relate to lasers or other digital lighting technologies.

Example systems and methods for a wall-mountable lighting device are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Referring to FIGS. 1-13, a wall-mountable luminaire will now be discussed. For purposes of definition, the term wall-mountable refers to adaptation to be carried by mechanical attachment to a substantially planar surface. Those skilled in the art will appreciate that a substantially planar surface is intended to note that the mounting surface may have a shape that is planar. Those skilled in the art will also appreciate that shapes of the surface that are not precisely planar are meant to be included within the scope and spirit of the embodiments of the present invention.

A wall mountable luminaire according to an embodiment of the present invention is preferably designed for use in applications wherein light emissions from a wall-mounted up light is desired to illuminate an adjoining wall surface. The luminaire, according to an embodiment of the present invention, may include power delivery components, lighting generation components, and mechanical support components. The components comprising the luminaire may be connected by any means known in the art, including, not by limitation, use of adhesives or glues, welding, interference fit, and fasteners. Alternatively, one or more components of the luminaire may be molded during manufacturing as an integral part of the luminaire.

Power Delivery

Figure 2:
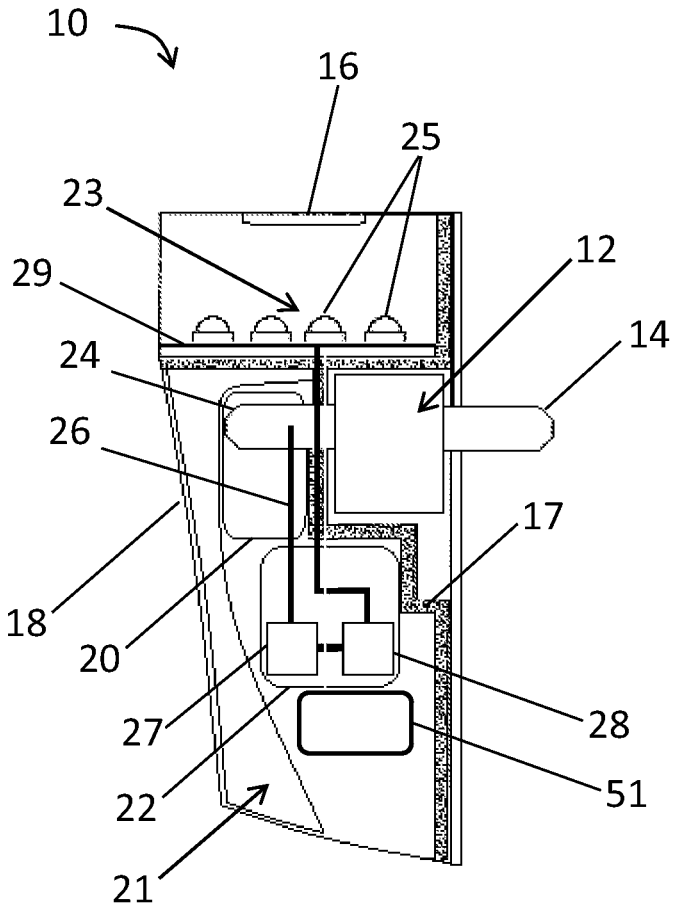
FIG. 2 is a cross-sectional view of the wall-mountable luminaire illustrated in FIG. 1 and taken through line 1A-1A of FIG. 1.

Referring more specifically to FIGS. 1 and 2, the power delivery components of the wall-mountable luminaire 10 will now be discussed. The luminaire 10, according to an embodiment of the present invention, may include one or more removable adapter plugs 12, a multi-standard socket 20, and a power supply 22.

Each removable adapter plug 12 may be configured to connect interchangeably to the multi-standard socket 20 and simultaneously to a complementary external power source, such as an electrical outlet (not shown). For example, and without limitation, an adapter plug 12 may have a first male connector 14 configured to removably couple to the electrical outlet. The first male connector 14 may be in the form of one or more plugs, pins, and prongs. Coupling of the first male connector 14 to the electrical outlet may complete an electrical connection with the external power source. For example, and without limitation, each of the adapter plugs 12 may be of a type that supports electrical input that may include 120V AC, 240V AC, 12V DC, and 24V DC. Each adapter plug 12 may receive electricity of at least one power type from the external source. Additionally, the coupling of the first male connector 14 to the electrical outlet may establish a mechanical connection that may mount the adapter 12 and, therefore, any components carried by the adapter 12, to the surface upon which the electrical outlet may be present.

Figure 3:
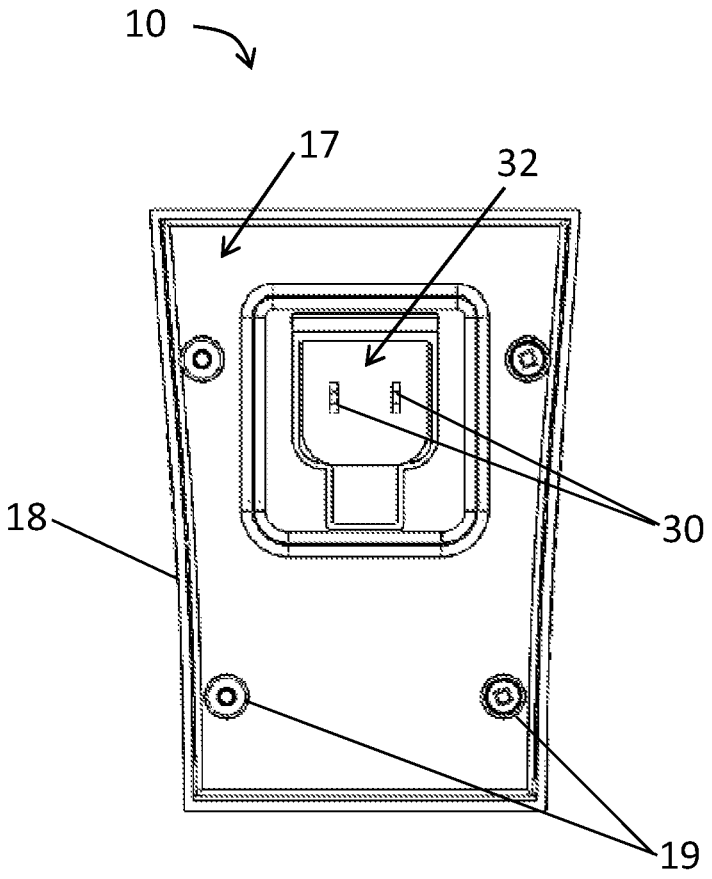
FIG. 3 is a rear elevation view of the wall-mountable luminaire illustrated in FIG. 1.
Figure 4:
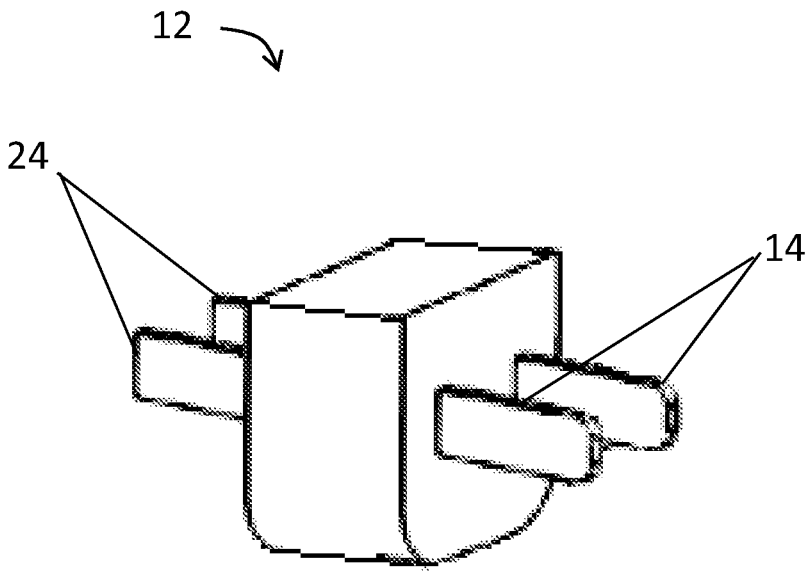
FIG. 4 is a top perspective view of a removable adapter plug of the wall-mountable luminaire illustrated in FIG. 1.

Continuing to refer to FIG. 2, and referring additionally to FIGS. 3 and 4, the multi-standard socket 20 may be configured to interchangeably mate with the various types of adapter plugs 12. More specifically, the socket 20 may include a female connector 30. The female connector 30 may be in the form of receptacle, socket, or slot. The female connector 30 may be configured to receive a second male connector 24. Coupling of the second male connector 24 to the female connector 30 may complete an electrical connection with the external power source through the first male connector 14. Additionally, the coupling of the second male connector 24 to the multi-standard socket 20 may establish a mechanical connection that may cause the multi-standard socket 20 and, therefore, any components carried by the socket 20, to be carried by the adapter plug 12.

Continuing to refer to FIG. 2, the power supply 22 of the luminaire 10, according to an embodiment of the present invention, is discussed in greater detail. For example, and without limitation, the power supply 22 may be an on-board power supply that may be electrically coupled 26 with the multi-standard socket 20. The power supply 22 may receive any one of the plurality of electrical power types transmitted from the external power source through the multi-standard socket 20. For example, the input power types supported by the power supply 22 may include one or more of 120V AC, 240V AC, 12V DC, and 24V DC. Manual and/or externally-directed specification of input power type may be facilitated by control signal input terminals (not shown) that may receive control signals related to power type. The power supply 22 may condition input power for output to lighting generation components based on the control signals. Alternatively, or in addition, dynamic identification of the input power type may be accomplished by a voltage meter/detector (not shown). The voltage meter/detector may detect an input power type, and transmit control signals to the power supply 22 which, in turn, may switch to the detected power type for conditioning purposes.

More specifically, the on-board power supply 22 may be configured to tailor and deliver electrical power that meets the requirements of those lighting generation components of the luminaire that need electricity to operate, as described in more detail below. For example, and without limitation, the on-board power supply 22 may have a converter 27 that may convert an AC input voltage to a DC output voltage for use by light-emitting diodes (LEDs) included in the lighting generation components. The on-board power supply also may have a regulator 28 that may sustain a DC output voltage within a target DC bias range for use by LEDs.

In one embodiment, the on-board power supply 22 may have at least one induction coil (not shown) configured to receive an AC input voltage from the multi-standard socket 20 through inductive coupling. In another embodiment, the on-board power supply 22 may have at least one wire connector 26 configured to receive the AC input voltage from the multi-standard socket 20 through conductive coupling. Additional information directed to the use of power supplies in an illumination apparatus is found in U.S. patent application Ser. No. 13/608,999 titled System for Inductively Powering an Electrical Device and Associated Methods, the entire contents of which are incorporated herein by reference.

Light Generation

Continuing to refer to FIG. 2, the lighting generation components of the wall-mountable luminaire 10 will now be discussed. The luminaire 10, according to an embodiment of the present invention, may include a heat sink 21, a heat generating element 23, an optic 16, and a controller 51.

Continuing to refer to FIG. 2, the heat sink 21 of the luminaire 10, according to an embodiment of the present invention, is discussed in greater detail. Thermal management capability of the luminaire 10 according to an embodiment of the present invention may be provided by one or more heat sinks 21. More specifically, the heat sink 21 may be configured to be thermally coupled to components of the luminaire 10 so as to increase the thermal dissipation capacity of the luminaire 10. More specifically, the heat sink 21 may be positioned adjacent to and in thermal communication with the heat generating element 23. For example, and without limitation, the heat sink 21 may present the substantially flat top portion with which the bottom surface of the heat generating element 23 may come into thermal contact. One or more fins of a heat sink 21 may be configured as projecting flanges (as illustrated in FIG. 2) that may be positioned opposite the portion of the heat sink 21 with which the heat generating element 23 makes contact. Accordingly, and as may be understood by those skilled in the art, the heat sink 21 advantageously may provide additional surface area for heat that may be produced by the heat generating element 23 to be dissipated.

For example, and without limitation, the heat sink 21 may include a number of fins configured to provide a larger surface area than otherwise may be provided by the surface of the heat generating element 23. In the embodiment of the invention illustrated in FIG. 2, the fins may be configured to extend substantially the length of the heat sink 21 and to project radially outward from a top portion of the heat generating element 23. Those skilled in the art will appreciate, however, that the present invention contemplates the use of fins that extend any distance, and that the disclosed heat sink 21 that includes fins that extend substantially the length thereof is not meant to be limiting in any way. The illustrated embodiment shows the fins of the heat sink 21 being curved to advantageously provide additional surface area to provide additional dissipation of heat. Also, employment of multiple fins may increase the surface area of the heat sink 21 and may permit thermal fluid flow between adjacent fins, thereby enhancing the cooling capability of the heat sink 21. Additionally, multiple fins may be identical in shape. Those skilled in the art will readily appreciate, however, that the fins of the heat sink 21 may be configured in any way while still accomplishing the many goals, features and advantages according to the present invention.

The heat sink 21 may be made by molding, casting, or stamping of a thermally conductive material. Materials may include, without limitation, thermoplastic, ceramics, porcelain, aluminum, aluminum alloys, metals, metal alloys, carbon allotropes, and composite materials. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference.

Continuing to refer to FIG. 2, the heat generating element 23 of the luminaire 10 according to an embodiment of the present invention is now discussed in greater detail. For example, and without limitation, the heat generating element 23 may be light source, which may be defined as any device capable of emitting light. The light source 23 may be a directional light source that may comprise one or more light emitting elements 25. The light emitting elements 25 may, for example and without limitation, include light-emitting semiconductors, such as light-emitting diodes (LEDs), lasers, incandescent, halogens, arc-lighting devices, fluorescents, and any other digital light-emitting device known in the art. In some embodiments of the present invention, the light source 23 may be an LED package that may include one or more LEDs 25 and a circuit board 29. The circuit board 29 may be configured to be functionally and/or mechanically coupled to the LEDs 25.

The heat sink 21 may be positioned adjacent the light source 23 and may be thermally coupled to the light source 23. This thermal coupling may be accomplished by any method, including thermal adhesives, thermal pastes, thermal greases, thermal pads, and all other methods known in the art. Where a thermal adhesive, paste, or grease is used, the heat sink 21 may be connected to any part of the light source 23 as may effectively cause thermal transfer between the light source 23 and the heat sink 21. Connection point location largely may depend on the heat distribution within the light source 23. For example, the heat sink 21 may be thermally coupled to one or more LEDs 25, to the circuit board 29, or to both. The circuit board 29 of the light source 23 may be sized to couple to the top portion of the heat sink 21. For example, and without limitation, the top portion of the heat sink 21 may be of a substantially matching shape, including a circle, ovoid, square, rectangle, triangle, or any other polygon. Those skilled in the art will appreciate that a substantially matching shape is intended to note that the shapes of the adjacent surfaces of the heat sink 21 and the light source 23 may be matching. Those skilled in the art will also appreciate that shapes of these surfaces that are not precisely matching are meant to be included within the scope and spirit of the embodiments of the present invention. The method of thermal coupling may be selected based on criteria including ease of application/installation, thermal conductivity, chemical stability, structural stability, and constraints placed by the luminaire 10.

Referring again to FIGS. 1 and 2, the optic 16 of the present embodiment will now be discussed in greater detail. The optic 16 may be positioned so as to define an optical chamber into which light emitted by the light source 23 may enter and subsequently pass through the optic 16. More specifically, the optic 16 may be configured to interact with light emitted by the light source 23 to refract incident light or to otherwise form a modified distribution pattern. Accordingly, the light source 23 may be disposed such that light emitted therefrom is incident upon the optic 16. The optic 16 may be formed in any shape to impart a desired refraction. Alternatively, or in addition, the optic 16 may be configured to generally diffuse light incident thereupon. In the present embodiment, the optic 16 has a generally flat geometry, although the optic 16 alternatively may have a substantially linear collimator, a curved emission surface, and/or a plurality of pillows configured to spread the combined light. Furthermore, the optic 16 may be formed of any material with transparent or translucent properties that comport with the desired refraction to be performed by the optic 16.

Referring now to the schematic representation illustrated in FIG. 5, and additionally to FIG. 2, a system 50 for operating a wall-mountable luminaire 10 according to an embodiment of the present invention will now be described in greater detail. The logical components of the luminaire 10 may include a controller 51 and the light source 23. Additionally, and as described in more detail below, the lighting generation components may include a communication network 57, as well as a local wireless receiver/transmitter 58 and a remote computerized device 54, 55 both in data communication with the communication network 57. As described above, the light source 23 may comprise a plurality of LEDs 25 each arranged to emit a source light to form a combined light. The controller 51 may be designed to control the characteristics of the combined light emitted by the light source 23 by generating control signals to selectively operate the LEDs 25. More specifically, the controller 51 may execute control program instructions using a processor 52 that may accept and execute computerized instructions, and also a data store 53 which may store data and instructions used by the processor 52. For example, and without limitation, the controller 51 may modulate one or more of the discrete light sources (e.g., LEDs 25) to produce colored light, to adjust color temperature, to control a switch to turn the light sources on or off, and/or to redirect the wash pattern created by the light source 23.

Also for example, and without limitation, the controller 51 may be configured to operate each of the plurality of light-emitting elements 25 so as to cause each light-emitting element 25 to emit light either at a full intensity or a fraction thereof. Many methods of dimming, or reducing the intensity of light emitted by a light-emitting element, are known in the art. Where the light-emitting elements 25 are LEDs, the controller 51 may use any method of dimming known in the art, including, without limitation, pulse-width modulation (PWM) and pulse-duration modulation (PDM). This list is exemplary only and all other methods of dimming a light-emitting element is contemplated and within the scope of the invention. Further disclosure regarding PWM may be found in U.S. Pat. No. 8,384,984 titled MEMS Wavelength Converting Lighting Device And Associated Methods, filed Mar. 28, 2011, the entire contents of which are incorporated by reference hereinabove.

Continuing to refer to FIG. 2, for example, and without limitation, the controller 51 may be positioned in electrical communication with the power supply 20 so as to be rendered operational. Alternatively, or in addition, the controller 51 may be operably connected to the light source 23 through the power supply 20. More specifically, the controller 51 may manipulate the output characteristics of the power supply 20 to modulate light emitted by the light source 23. For example, and without limitation, the controller 51 may be configured to operate the light source 23 between operating and non-operating states, wherein the light source 23 emits light when operating, and does not emit light when not operating. The controller 51 may comprise a variable resistor, a capacitor and a diode alternating current switch. The switch may, for example, be a silicon controlled rectifier.

Figure 5:
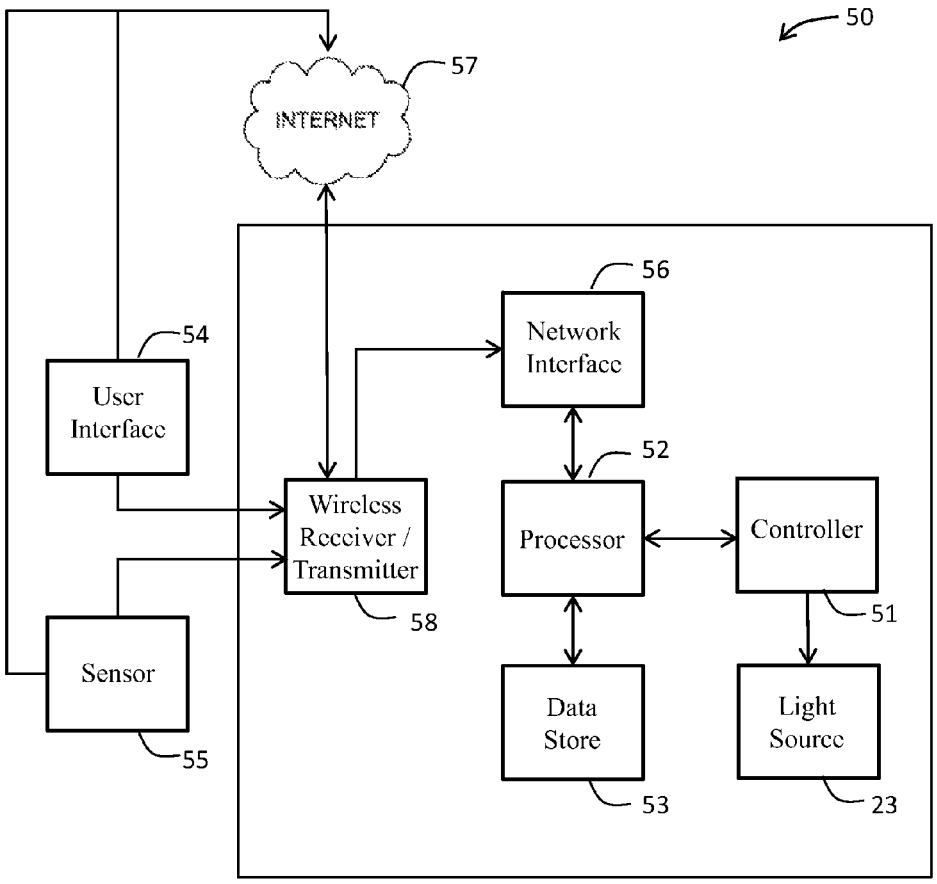
FIG. 5 is a schematic block diagram of system components of a wall-mountable luminaire according to an embodiment of the present invention.
Figure 6:
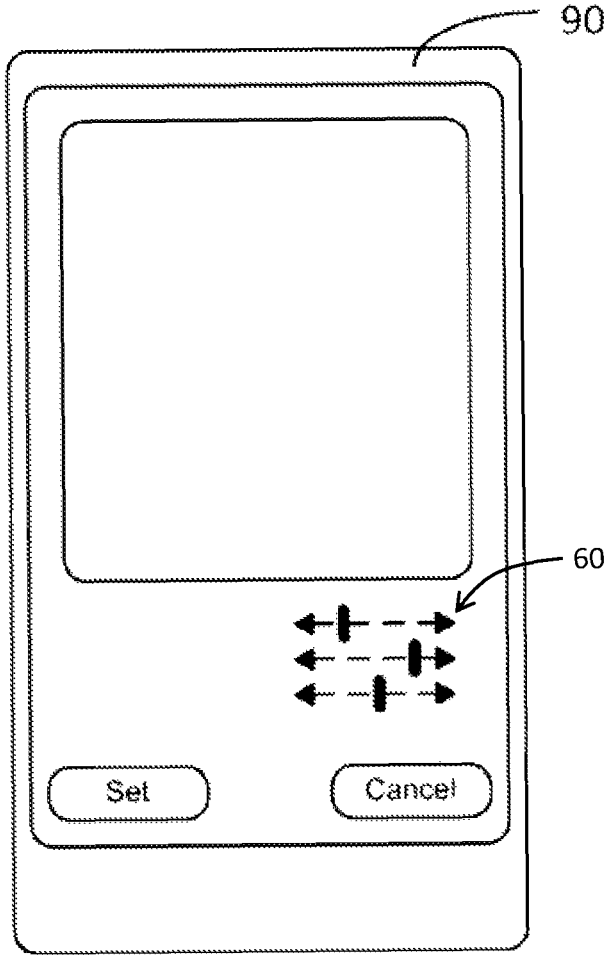
FIG. 6 is a schematic diagram of an exemplary user interface to be used in connection with the wall-mountable luminaire according to an embodiment of the present invention.
Figure 7:
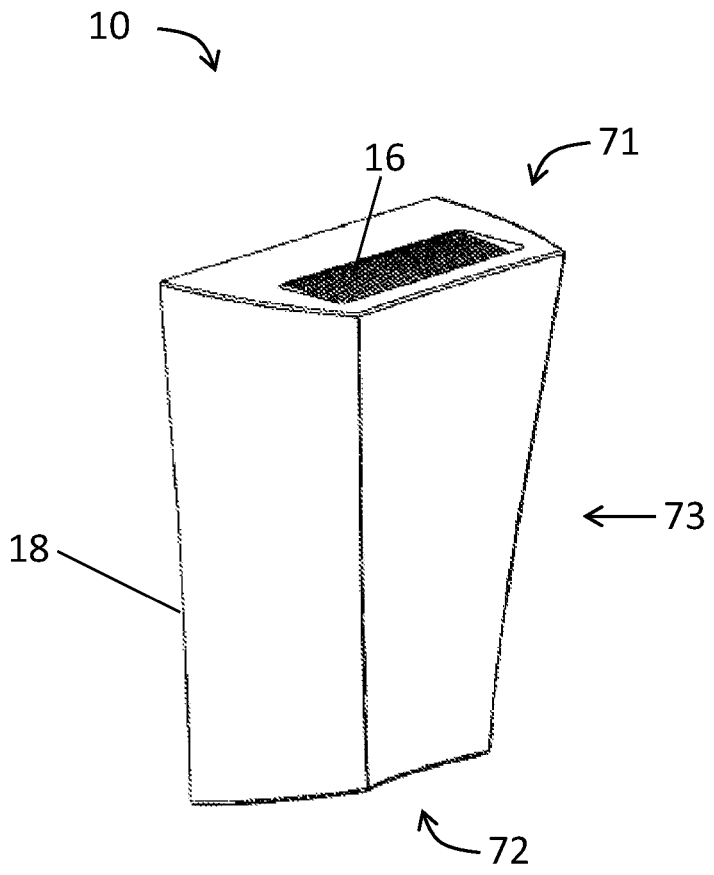
FIG. 7 is a top front perspective view of the wall-mountable luminaire illustrated in FIG. 1.
Figure 8:
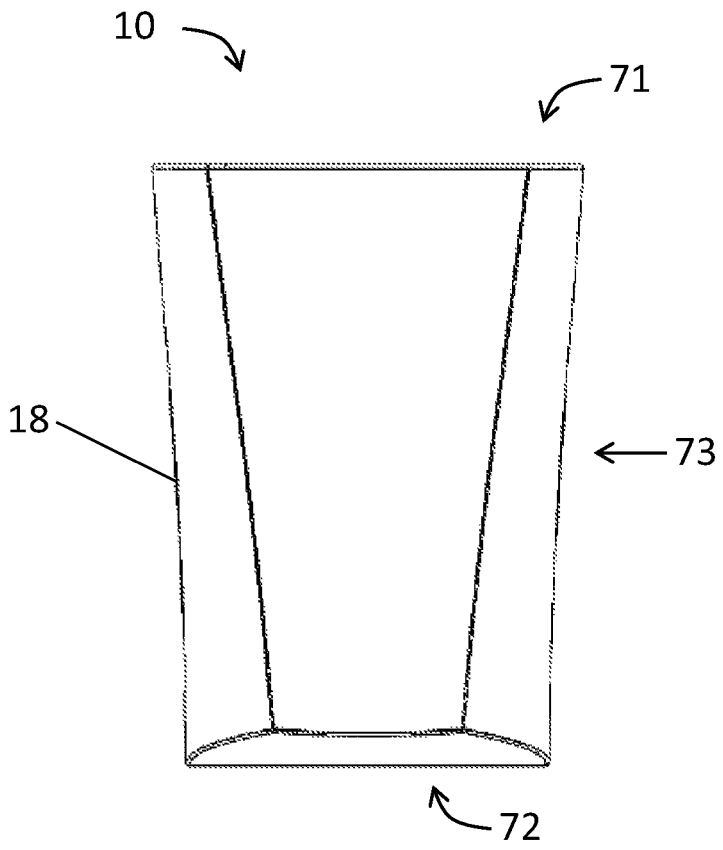
FIG. 8 is a front elevation view of the wall-mountable luminaire illustrated in FIG. 1.
Figure 9:
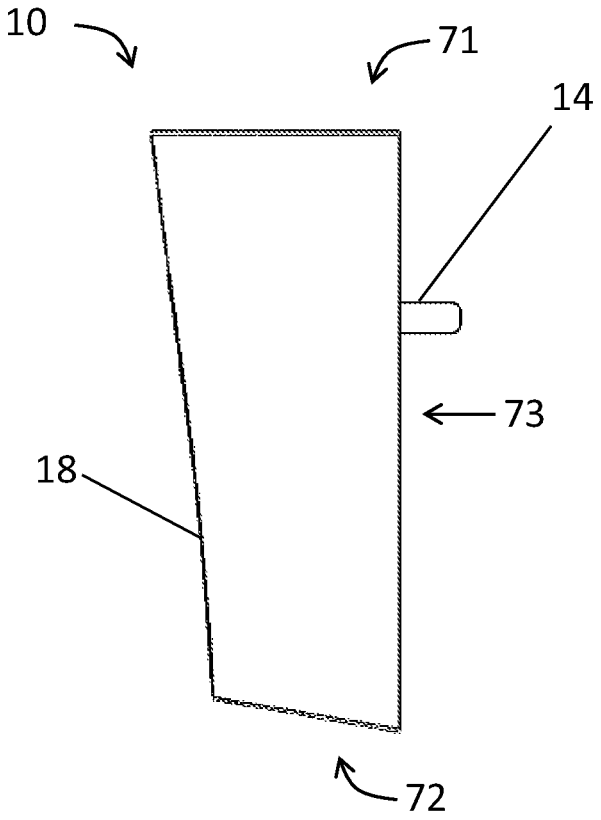
FIG. 9 is a side elevation view of the wall-mountable luminaire illustrated in FIG. 1.
Figure 10:
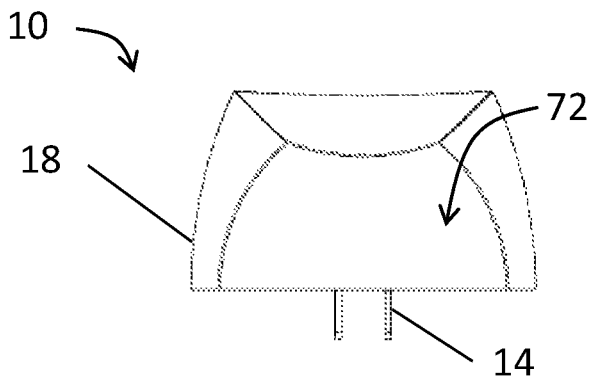
FIG. 10 is a bottom plan view of the wall-mountable luminaire illustrated in FIG. 1.
Figure 11:
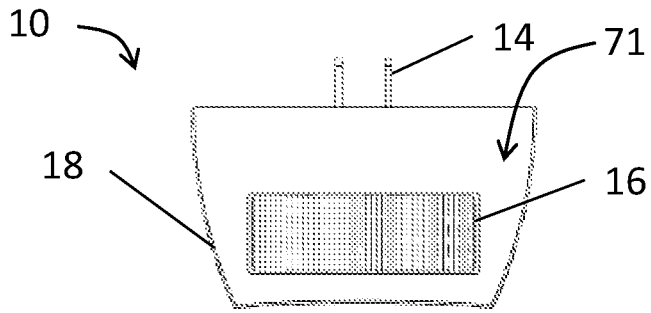
FIG. 11 is a top plan view of the wall-mountable luminaire illustrated in FIG. 1.

Referring now to FIGS. 5 and 6, the luminaire 10 may comprise a wireless receiver/transmitter 58 that may be in data communication with devices external to the luminaire. For example, and without limitation, the controller 51 may be programmed to selectively operate the light source 23 in response to electronic communication received from an external device 54, 55 using the wireless receiver. The controller 51 may receive control data from the wireless receiver 58 defining desired light characteristics, and may generate the control signals such that the combined light exhibits the light characteristics. The control data may include a light generation command such as a dimmer command, an on/off command, a color change command, and a wash pattern redirect command. The control data may be transmitted by the remote computerized device 54, 55 through the communication network 57 to the wireless receiver 58. For example, and without limitation, the wireless receiver 58 may receive data encoded to a standard network protocol such as 802.3 Ethernet, 802.11 Wi-Fi, 802.15.1 Bluetooth, 802.15.4 low rate personal area network (PAN), packet switching wide area networks (WAN), and cellular relay WAN.

Continuing to refer to FIG. 5, the wall mountable luminaire 10 of the present invention may include a network interface 56 to allow the luminaire 10 to be positioned in communication with a network 57 in order to receive signals to carry out various functions. More specifically, the control data communication may be carried by a communications network 57 from the external device 54, 55 to the network interface 56 of the luminaire 10 through the wireless receiver 58. The controller 51 also may be configured to transmit beam characteristics to an external device (such as another luminaire 10) through the wireless transmitter 58 to the network 57. Additional details regarding communication of control data to and from the luminaire 10 may be found in U.S. Provisional Patent Application Ser. No. 61/486,314 titled Wireless Lighting Device and Associated Methods, as well as U.S. patent application Ser. No. 13/463,020 titled Wireless Pairing System and Associated Methods and U.S. patent application Ser. No. 13/269,222 titled Wavelength Sensing Light Emitting Semiconductor and Associated Methods, the entire contents of each of which are incorporated herein by reference.

A person of skill in the art will appreciate that the network interface 56 may be included within the controller 51 discussed above. Alternately, a skilled artisan will appreciate that the network interface 56 may be operatively connected to the controller 51, wherein it may operate as an interface device between the controller 51 and a connected network 57, such as for example, a home or corporate network. The network interface 56 may connect to a network 57 via a proprietary or standard connection protocol. With respect to embodiments of the present invention that include a proprietary network connection, the network interface 56 may perform handshake operations and exchange data with network connected devices, as may be defined within the proprietary protocol. Alternately, the network interface 56 may connect to a network 57 via a standardized protocol. Examples of standardized protocols, provided without the intent to be limiting, may include 802.3 Ethernet, 802.11 Wi-Fi, 802.15.1 Bluetooth, 802.15.4 low rate personal area network (PAN) environments, packet switching wide area networks (WAN), cellular relay WANs, or additional standardized data transmission protocols.

Continuing to refer to FIG. 5, and referring additionally to FIG. 6, an exemplary user interface 54 will be discussed. The network interface 56 may provide a channel for the electronic communication of data between the wall-mountable luminaire 10 and a network connected device 90. For example, and without limitation, a user interface 54 and/or a sensor 55 may be configured to program the controller 51 to control the emissions characteristics of the light source 23. Examples of network connected devices 90 may include personal computers (PC), tablets, smartphones, personal data assistants, remote data centers, or other electronic devices capable of connecting to a network.

The user interface 54 may be provided by a handheld device 90, such as, for example, any mobile device, or other network connectable device, which may provide a user with the ability to operate the wall mountable luminaire 10 according to an embodiment of the present invention. More specifically, the processor 52 may be configured to receive the input transmitted from some number of external devices 54, 55 and to direct that input to the data store 53 for storage and subsequent retrieval. The processor 52 may be in data communication with the external devices 54, 55 through a direct connection and/or through a network connection 56 to a network 57. For example, the both the hand held device 90 and the luminaire 10 may be connected to a network 57 so that a signal may be transmitted through the network 57 using the handheld device 90 to operate the luminaire. Alternately, the luminaire 10 may directly connect to the handheld device 90 using a communications interface protocol such as, for example, Bluetooth, or any of the other communications interface protocols indicated above. In such a case, as the handheld device 90 comes within a particular range of the wall mountable luminaire 10, it becomes possible to send control data directly from the handheld device 90 to the wall mountable luminaire 10 in order to control various functions of the light source 23.

The user interface 54 may comprise a beam adjustment device 90 that may be configured to electronically communicate beam characteristics to the controller 51. The controller 51 may be programmed to selectively operate the light source 23 in response to the beam characteristics instructions received. Operation of the beam adjustment device 90 may be electrical, electronic, electromagnetic, or magnetic. As illustrated FIG. 6, the beam adjustment device 90 may include slider controls 60 for any number of light characteristics, such as hue, saturation, and luminance.

Continuing to refer to FIG. 5, it is also contemplated that the controller 51 may be used to remotely operate the luminaire 10, program the luminaire 10 (i.e., turn on at a certain time, turn off at a certain time, etc.) or even operate the luminaire 10 upon sensing a particular condition. In such a case, it is contemplated that the wall mountable luminaire 10 may include an incorporated sensor 55, or may be positioned in communication with a sensor 55. For example, and without limitation, the sensor 55 may comprise an occupancy sensor and/or a timer may be employed for automatic selection and communication of beam characteristics to the controller 51. The sensor 55 may transmit a signal to the controller 51 indicating that the controller 51 should either operate the light source 23 or cease operation of the light source 23. For example, the sensor 55 may be an occupancy sensor that detects the presence of a person within a field of view of the occupancy sensor 55. When a person is detected, the occupancy sensor 55 may indicate to the controller 51 that the light source 23 should be operated so as to provide lighting for the detected person. Accordingly, the controller 51 may operate the light source 23 so as to provide lighting for the detected person.

Furthermore, the occupancy sensor 55 may either indicate that lighting is no longer required when a person is no longer detected, or either of the occupancy sensor 55 or the controller 51 may indicate lighting is no longer required after a period of time transpires during which a person is not detected by the occupancy sensor 55. Accordingly, in either situation, the controller 51 may cease operation of the light source 23, terminating lighting of the environment surrounding the luminaire 10. The sensor 55 may be any sensor capable of detecting the presence or non-presence of a person in the environment surrounding the luminaire 10, including, without limitation, infrared sensors, motion detectors, and any other sensor of similar function known in the art. Additional information regarding incorporating a sensor into a luminaire, or using a sensor in connection with a luminaire, may be found in U.S. patent application Ser. No. 13/403,531, entitled Configurable Environmental Sensing Luminaire, System and Associated Methods, filed Feb. 23, 2012, and U.S. patent application Ser. No. 13/464,345, entitled Occupancy Sensor and Associated Methods, filed May 4, 2012, the entire contents of both of which are herein incorporated by reference.

Mechanical Support

Referring again to FIGS. 1 to 3, and referring additionally to FIGS. 7 to 11, the mechanical support components of the present embodiment of the wall-mountable luminaire 100 will now be discussed. The mechanical support components may include a housing assembly 17 and a trim assembly 18. As illustrated in FIG. 1, the wall mountable luminaire 10 according to an embodiment of the present invention may be designed for mechanical mounting directly to a wall outlet (not shown).

Continuing to refer to FIGS. 1, 2, and 3, the housing assembly 17 may be configured to carry the multi-standard socket 20, the power supply 22, the heat sink 21, the light source 23, the controller 51, and the trim assembly 18. The top portion of the heat sink also may be configured to make mechanical contact with the light 23, thereby fixing the orientation of the light source 23 within the luminaire 10 during normal operation. The housing assembly 17 may have a substantially planar mounting configured for positioning adjacent to a generally flat surface, such as a wall. Those skilled in the art will appreciate that a substantially planar surface is intended to note that the mounting surface may have a shape that is planar. Those skilled in the art will also appreciate that shapes of the surface that are not precisely planar are meant to be included within the scope and spirit of the embodiments of the present invention.

The housing assembly 17 also may have a recessed portion 32 configured to individually receive each of the plurality of adapter plugs 12. When connected mechanically to the multi-standard socket 20, an engaged adapter plug 12 may be disposed adjacent to the recessed portion 32. In this manner, each of the adapter plugs 12 may be interchangeably connectable mechanically to the housing assembly 17. As installed, the multi-standard socket 20/adapter plug 12 combination may provide mechanical support for the wall-mountable luminaire 10 when plugged in to an electrical outlet on the wall.

Additionally, the housing assembly 17 may carry the wireless receiver/transmitter 58 and the heat sink 21. For example, and without limitation, the housing assembly 18 also may have an electromagnetic interference shield that advantageously may shield the wireless receiver/transmitter 58 from electromagnetic emissions from the heat sink 21.

Continuing to refer to FIGS. 1 and 3, and referring additionally to FIGS. 7 to 11, the trim assembly 18 may include a base 72, sidewalls 73 extending upwardly from the base 72, and a top 71 carried by the sidewalls 73. The trim assembly 18 may advantageously provide aesthetic and protective cover for the components assembled to be carried by the housing assembly 17. The top 71 of the trim assembly 18 may include the optic 16. As shown in FIG. 2, the rear of the trim assembly 18 may present a substantially planar edge that may support flush mounting on a flat surface such as a wall. Those skilled in the art will appreciate that a substantially planar edge is intended to note that the mounting edge may define a shape that is planar. Those skilled in the art will also appreciate that shapes of the edge that are not precisely planar are meant to be included within the scope and spirit of the embodiments of the present invention.

The trim assembly 17 may define an interior cavity configured to contain one or more of the multi-standard socket 20, the heat sink 21, the power supply 22, the light source 23, and other power delivery components and lighting generation components. In such a configuration, the trim assembly 18 may substantially cover and obscure from view all of the components of the luminaire 10 that may be configured to be carried by the housing assembly 17, thereby advantageously presenting a low-profile and aesthetically pleasing appearance of the luminaire 10. For example, and without limitation, the trim assembly 18 may be formed into any tubular shape, including a circle, ovoid, square, rectangle, triangle, or any other polygon. The cavity formed by the substantially hollow interior of the tubular shape may be configured to receive various components and circuitry of the luminaire 10. For example, and without limitation, the cavity may present a cylinder of sufficient diameter to permit wires to pass therethrough from the light source 23 to the power supply 22. Those skilled in the art will appreciate that an electrical connector for the light source 23 may be provided by any type of connector that is suitable for connecting the light source 23 to a power source 22.

For example, and without limitation, the housing assembly 17 and/or the trim assembly 18 may be constructed of a lightweight, thermal insulating material such as inorganic material, organic foam material, polyurethane material, polystyrene material, glass fiber material, aerogel material, and microporous material. Those of ordinary skill in the art will understand that multiple types of trim assemblies are available and may be used with the present invention. The trim assembly 18 may be affixed to the housing assembly 17 by a variety of different fastener means such as screws 19, clips, and ball detents, all of which are well known to those of ordinary skill in the art.

Alternatively, or in addition, the housing assembly 17 and/or the trim assembly 18 may be in thermal communication with the light source 23, the heat sink 21, and/or the power supply 22. For example, and without limitation, the housing assembly 17 and/or the trim assembly 18 may be constructed of a heat dissipating material such as thermoplastic, ceramics, porcelain, aluminum, aluminum alloys, metals, metal alloys, carbon allotropes, and composite materials.

Referring additionally to FIG. 2, the housing assembly 17 and the trim assembly 18 may be positioned to substantially encase the heat sink 21 within the cavity. The cavity may be configured to have spatial characteristics permitting fluid flow within the cavity. For example, and without limitation, the fluid flow within the cavity may cause the transfer of heat from the light source 23 through the top portion of the heat sink 21, which may then transfer the heat to the fins and subsequently to the environment either internal or external to the cavity where the heat may dissipate. To permit fluid to flow unimpeded to the external environment from the cavity after that fluid has traversed through the circuit board 29 to the heat sink 21, the housing assembly 17 and/or trim assembly 18 may comprise one or more vents (not shown) generally adjacent to the fins of the heat sink 21. Alternatively, if a design object is to maintain a fluid seal between the cavity and the environment external to the luminaire 10, the housing assembly 17 and the trim assembly 18 may further include a sealing member (not shown). The sealing member may include any device or material that can provide a fluid seal as described above. For example, and without limitation, the sealing member may form a fluid seal between the trim assembly 18 and the housing assembly 17.

Accordingly, the spatial characteristics of the cavity may directly correspond to the amount of heat that can be transported from the luminaire 10 to the dissipating environment. Spatial characteristics that can be modified may include total volume, fluid flow characteristics, interior surface area, and exterior surface area. For example, and without limitation, one or more surfaces of the housing assembly 17 and/or the trim assembly 18 may be textured or include grooves to increase the surface area of the combined enclosure 17, 18, thereby facilitating thermal transfer thereto.

The aforementioned spatial characteristics may be modified to accommodate the heat generated by the light source 23 of the luminaire 10. For instance, the volume of the cavity may be directly proportional to the thermal output of the luminaire 10. Similarly, a surface area of some part of the heat sink 21 may be proportional to the thermal output of the luminaire 10. In any case, the cavity may be configured to maintain the temperature of the luminaire 10 at thermal equilibrium or within a target temperature range. Moreover, thermal properties of the materials used to form the housing assembly 17 and/or the trim assembly 18 may be considered in forming the thermal management system for the luminaire 10. Other embodiments may have the cavity disposed on other parts of the assembled housing assembly 17 and trim assembly 18.

Operation Method

Figure 12:
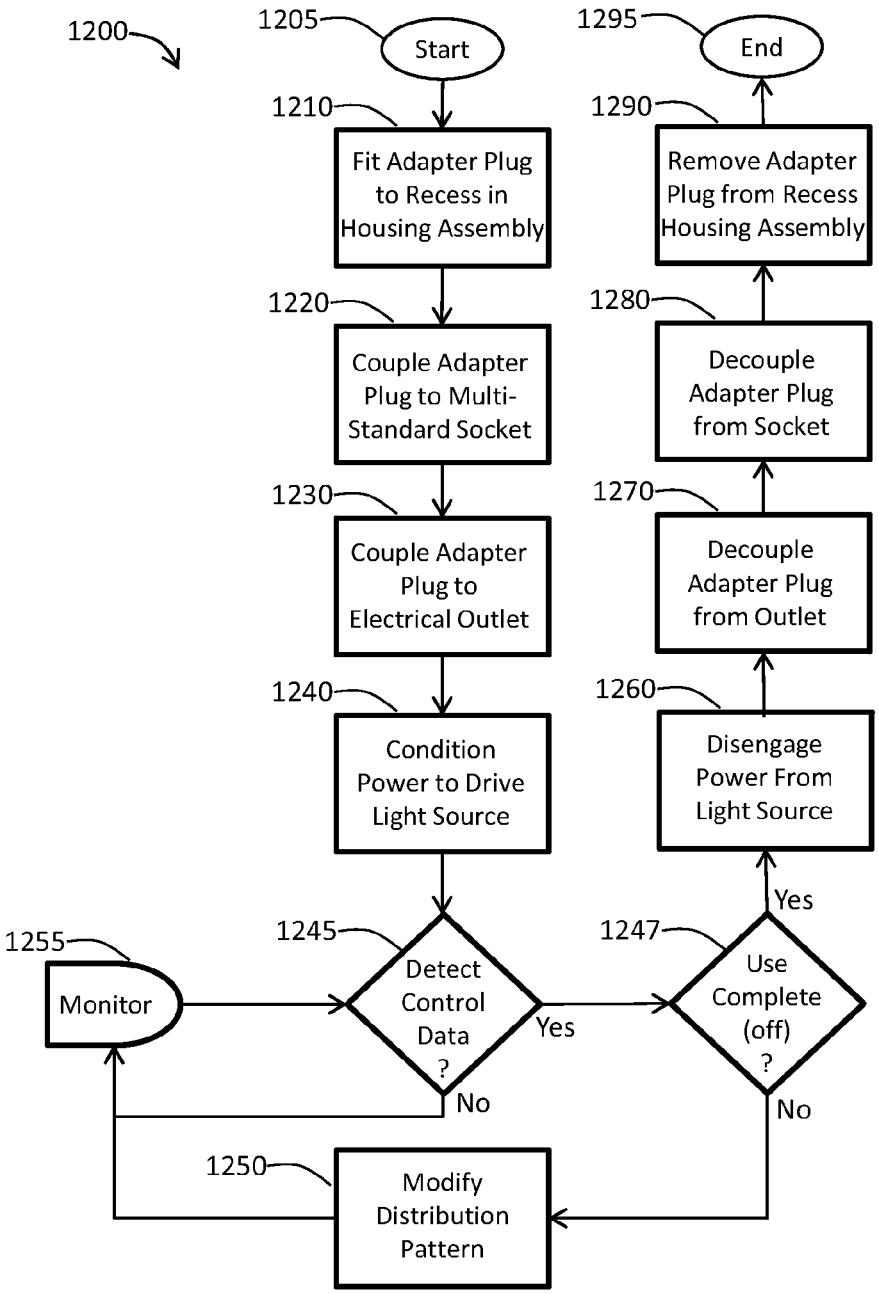
FIG. 12 is a flow chart detailing a method of operating an embodiment of a wall-mountable luminaire according to the present invention.

Referring now to flowchart 1200 of FIG. 12, a method aspect of the present invention for operating the wall-mountable luminaire 10 to produce wall-wash illumination will now be discussed. From the start 1205, the method may include the step of fitting one of the plurality of adapter plugs 12 into the recessed portion of the housing assembly 17 (Block 1210). At Block 1220, the selected adapter plug 12 may be electrically and mechanically coupled to the multi-standard socket 20 by inserting the second male connector 24 to the recess 32 in the housing assembly 17. Then, the first male connector 14 of the adapter plug 12 may be electrically and mechanically coupled to an electrical outlet (Block 1230). Completion of this step may position the housing assembly 17 flush to an electrical outlet. At Block 1240, the power supply 22 may receive of input power of the type supported by the electrical outlet and, as needed, condition that electrical feed to meet the requirements of downstream lighting generation components. For example, and without limitation, if the power supply 22 may be tasked with delivering power to LEDs 25 as a light source 23, then conditioning may entail converting input AC voltage to output DC voltage and regulating that DC voltage within a target bias range.

If at Block 1245 the controller 51 detects an incoming control data defining light characteristics, and if those control data do not initiate turning off of the luminaire 10 (Block 1247), then the controller 51 may comply with the control data. More specifically, the control data may program the controller 51 to operate the light source 23 to exhibit the light characteristics. For example, and without limitation, the control data may direct modification of the distribution of the wall-wash light distribution pattern (Block 1250). Control data may be received from the wireless receiver 58 as transmitted across a communication network 57 by remote control devices 54, 55. The controller 51 may continue to monitor the wireless receiver 58 for incoming control data (Block 1255) until data directing that the luminaire 10 be turned off is received (Block 1247). Turning off the luminaire 10 may entail electrically disengaging the power supply 22 from the light source 23 (Block 1260). Preparing the luminaire 10 for reconfiguration in anticipation of its next use may include the step of decoupling the adapter plug 12 from the external electrical outlet (Block 1270). After completion of this step, the luminaire 10 may no longer be positioned adjacent to the wall because of its mechanical coupling to the removed adapter plug 12. The adapter plug 12 may be decoupled from the multi-standard socket 20 (Block 1280) and removed from the recess 32 in the housing assembly 17 (Block 1290) in anticipation of interchangeably replacing that adapter 12 with another of the plurality of adapters 12 included in the luminaire 10. The method ends at Block 1295.

As will be understood by those of ordinary skill in the art, after having had the benefit of reading this disclosure, a plurality of wall mountable luminaires 10 may be operated simultaneously, each using the method described above, when it is necessary to illuminate a wall having a large surface.

Computing Configuration

Figure 13:
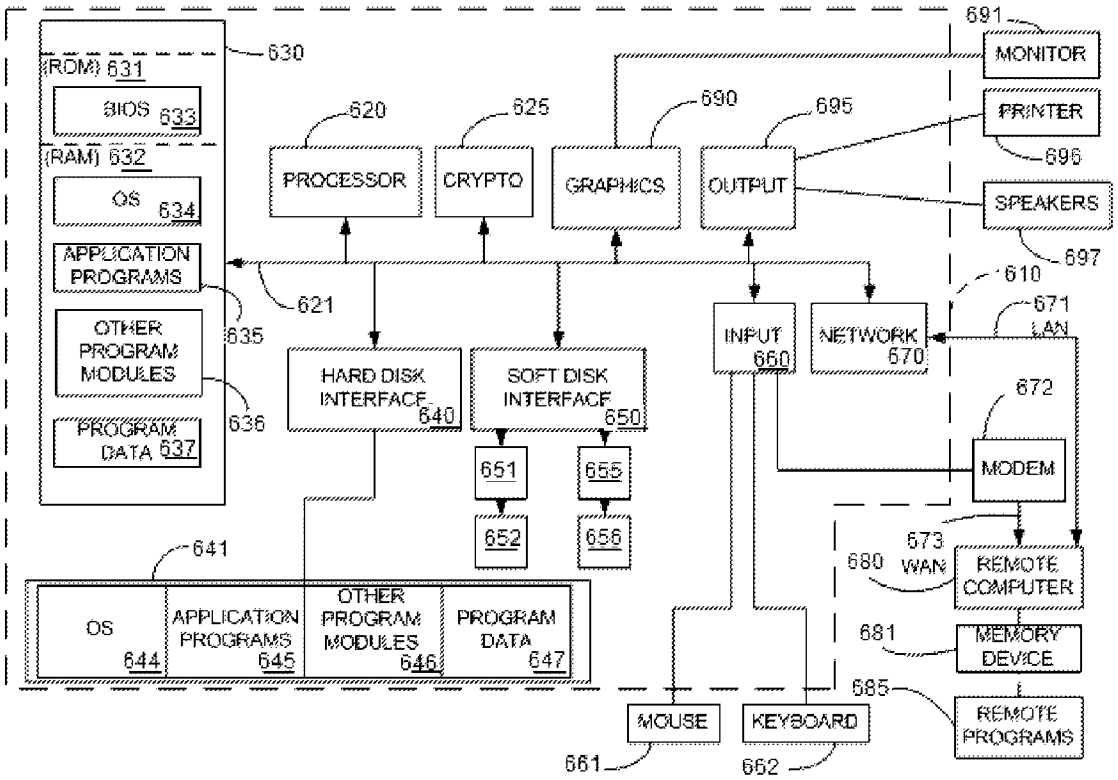
FIG. 13 is a block diagram representation of a machine in the example form of a computer system according to an embodiment of the present invention.

A skilled artisan will note that one or more of the aspects of the present invention may be performed on a computing device. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 13 illustrates a model computing device in the form of a computer 610, which is capable of performing one or more computer-implemented steps in practicing the method aspects of the present invention. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 610 may also include a cryptographic unit 625. Briefly, the cryptographic unit 625 has a calculation function that may be used to verify digital signatures, calculate hashes, digitally sign hash values, and encrypt or decrypt data. The cryptographic unit 625 may also have a protected memory for storing keys and other secret data. In other embodiments, the functions of the cryptographic unit may be instantiated in software and run via the operating system.

A computer 610 typically includes a variety of computer readable media. Computer readable media can be any available media that can be accessed by a computer 610 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 610. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 13 illustrates an operating system (OS) 634, application programs 635, other program modules 636, and program data 637.

The computer 610 may also include other removable/non-removable, volatile/nonvolatile computer storage media. By way of example only, FIG. 13 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives, and their associated computer storage media discussed above and illustrated in FIG. 13, provide storage of computer readable instructions, data structures, program modules and other data for the computer 610. In FIG. 13, for example, hard disk drive 641 is illustrated as storing an OS 644, application programs 645, other program modules 646, and program data 647. Note that these components can either be the same as or different from OS 633, application programs 633, other program modules 636, and program data 637. The OS 644, application programs 645, other program modules 646, and program data 647 are given different numbers here to illustrate that, at a minimum, they may be different copies. A user may enter commands and information into the computer 610 through input devices such as a keyboard 662 and cursor control device 661, commonly referred to as a mouse, trackball or touch pad. Other input devices (not shown) may include a microphone, joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a graphics controller 690. In addition to the monitor, computers may also include other peripheral output devices such as speakers 697 and printer 696, which may be connected through an output peripheral interface 695.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 13. The logical connections depicted in FIG. 13 include a local area network (LAN) 671 and a wide area network (WAN) 673, but may also include other networks 140. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660, or other appropriate mechanism. In a networked environment, program modules depicted relative to the computer 610, or portions thereof, may be stored in the remote memory storage device. By way of example, and not limitation, FIG. 13 illustrates remote application programs 685 as residing on memory device 681.

The communications connections 670 and 672 allow the device to communicate with other devices. The communications connections 670 and 672 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. The scope of the invention should be determined by the appended claims and their legal equivalents, and not by the examples given Therefore, it is understood that the invention is not to be limited to the specific embodiments disclosed.

What is claimed is:

1. A wall-mountable luminaire comprising:

a housing assembly;

a removable adapter plug removeably carried by the housing assembly, and configured to mechanically and electrically couple to an electrical outlet;

a multi-standard socket carried by the housing assembly, and configured to mechanically and electrically couple to the adapter plug;

a power supply carried by the housing assembly, and positioned in electrical communication with the multi-standard socket and configured to receive a plurality of power types;

a light source carried by the housing assembly, and positioned in electrical communication with the power supply and comprising a plurality of light-emitting elements each operable to emit a source light;

a controller carried by the housing assembly, and positioned in electrical communication with the light source and configured to generate control signals to selectively operate the plurality of light-emitting elements such that the source lights emitted by the plurality of light emitting elements combine to form a combined light; and a trim assembly carried by the housing assembly, and configured to generally cover the housing assembly, the adapter plug, the multi-standard socket, the power supply, the light source, and the controller.

2. The wall-mountable luminaire according to claim 1 wherein the plurality of power types is selected from the group consisting of 120V AC, 240V AC, 12V DC, and 24V DC.

3. The wall-mountable luminaire according to claim 2 wherein the housing assembly comprises a substantially planar mounting and a recessed portion; wherein the adapter plug is disposed adjacent to the recessed portion.

4. The wall-mountable luminaire according to claim 3 wherein the adapter plug comprises a plurality of adapter plugs, each of which are configured to receive at least one of the plurality of power types, are interchangeably connectable mechanically to the housing assembly, and are interchangeably connectable electrically to the multi-standard socket; wherein the recessed portion is configured to individually receive each of the plurality of adapter plugs.

5. The wall-mountable luminaire according to claim 1 wherein at least one of the plurality of light-emitting elements comprises a light-emitting diode (LED).

6. The wall-mountable luminaire according to claim 5 wherein the power supply is configured to detect an input AC voltage and to convert the input AC voltage to an output DC voltage.

7. The wall-mountable luminaire according to claim 1 further comprising a wireless receiver in electrical communication with the controller and carried by the housing assembly; wherein the controller is configured to receive control data from the wireless receiver defining light characteristics and to generate the control signals to selectively operate the plurality of light-emitting elements such that the combined light exhibits the light characteristics.

8. The wall-mountable luminaire according to claim 7 wherein the control data includes a light generation command selected from the group consisting of a dimmer command, an on/off command, a color change command, and a wash pattern redirect command.

9. The wall-mountable luminaire according to claim 7 further comprising a heat sink in thermal communication with the plurality of light-emitting elements and carried by the housing assembly; wherein the housing assembly further comprises an electromagnetic interference shield that shields the wireless receiver from electromagnetic emissions from the heat sink.

10. The wall-mountable luminaire according to claim 1 wherein the trim assembly comprises a base, sidewalls extending upwardly from the base and a top carried by the sidewalls; and further comprises an optic carried by the top and disposed adjacent to the light source to define an optical chamber; wherein the combined light enters the optical chamber and passes through the optic to form a modified distribution pattern.

11. The wall-mountable luminaire according to claim 10 wherein the optic further comprises one of a substantially linear collimator, a curved emission surface, and a plurality of pillows configured to spread the combined light.

12. An illumination system providing remotely-configurable wall-wash illumination comprising:

a communication network;

a remote computerized device in data communication with the communication network; and a wall-mountable luminaire comprising:

a housing assembly;

an adapter plug removeably carried by the housing assembly, and configured to mechanically and electrically couple to an electrical outlet;

a power supply carried by the housing assembly, and positioned in electrical communication with the adapter plug and configured to receive an electric current of a plurality of power types selected from the group consisting of 120V AC, 240V AC, 12V DC, and 24V DC;

a light source carried by the housing assembly, and positioned in electrical communication with the power supply and comprising a plurality of light-emitting elements each operable to emit a source light;

a wireless receiver carried by the housing assembly, and positioned in data communication with the communication network;

a controller carried by the housing assembly, and positioned in electrical communication with the light source and with the wireless receiver, and configured to generate control signals to selectively operate the plurality of light-emitting elements such that the source lights emitted by the plurality of light emitting elements combine to form a combined light; and a trim assembly carried by the housing assembly, and configured to generally cover the housing assembly, the adapter plug, the power supply, the light source, the wireless receiver, and the controller.

13. The illumination system according to claim 12 wherein the remote computerized device is selected from the group consisting of a personal computer (PC), a tablet, a smartphone, a personal data assistant, and a wireless remote control.

14. The illumination system according to claim 12 wherein the wireless receiver is configured to receive data encoded to a standard network protocol of a type selected from the group consisting of 802.3 Ethernet, 802.11 Wi-Fi, 802.15.1 Bluetooth, 802.15.4 low rate personal area network (PAN), packet switching wide area networks (WAN), and cellular relay WAN.

15. The illumination system according to claim 12 wherein at least one of the plurality of light-emitting elements comprises a light-emitting diode (LED), and wherein the power supply is configured to detect an input AC voltage and to convert the input AC voltage to an output DC voltage.

16. The illumination system according to claim 12 wherein the wall mountable luminaire further comprise a wireless receiver in electrical communication with the controller and carried by the housing assembly; wherein the controller is configured to receive control data from the wireless receiver defining light characteristics and to generate the control signals to selectively operate the plurality of light-emitting elements such that the combined light exhibits the light characteristics; and wherein the control data includes a light generation command selected from the group consisting of a dimmer command, an on/off command, a color change command, and a wash pattern redirect command.

17. A method of producing wall-wash illumination using an illumination system comprising a wall-mountable luminaire comprising a housing assembly, an adapter plug, a multi-standard socket, a power supply, a light source, a controller, and a trim assembly, the method comprising:

mechanically and electrically coupling the multi-standard socket to the adapter plug;

positioning the adapter plug into a recessed portion of the housing assembly;

mechanically and electrically coupling the adapter plug to a standard electrical outlet with a mounting of the housing assembly positioned flush to a substantially flat surface of the standard electrical outlet;

receiving at the power supply one of a plurality of power types selected from the group consisting of 120V AC, 240V AC, 12V DC, and 24V DC; and operating a plurality of light-emitting elements in the light source such that source lights emitted by the plurality of light emitting elements combine to form a combined light.

18. The method according to claim 17 wherein at least one of the plurality of light-emitting elements comprises a light-emitting diode (LED); the method further comprising:

receiving at the power supply one of the plurality of power types selected from the group consisting of 120V AC and 240V AC, and defined as an AC voltage;

converting the AC voltage to a 12V DC voltage;

regulating the 12V DC voltage to drive the LED.

19. The method according to claim 17 wherein the wall-mountable luminaire further comprises a communication network, a remote computerized device, and a wireless receiver; the method further comprising:

positioning the controller in data communication with the remote computerized device;

receiving by the wireless receiver control data wirelessly transmitted from the communication network and defining light characteristics; and programming the controller responsive to the control data;

wherein the step of programming the controller causes the controller to generate control signals to selectively operate a subset of the plurality of light-emitting elements such that the combined light exhibits the light characteristics.

20. The method according to claim 17 wherein the wall-mountable luminaire further comprises a trim assembly having a base, sidewalls extending upwardly from the base and a top carried by the sidewalls; and further comprising an optic carried by the top and disposed adjacent to the light source to define an optical chamber; the method further comprising:

covering using the trim assembly the housing assembly, the adapter plug, the multi-standard socket, the power supply, the light source, and the controller;

directing the combined light into the optical chamber;

passing the combined light through the optic to form a modified distribution pattern.

* * * * *